US007705543B2

(12) United States Patent
Ragonesi et al.

(10) Patent No.: US 7,705,543 B2
(45) Date of Patent: Apr. 27, 2010

(54) SUPPLY DEVICE OF CIRCUIT BRANCHES WITH LED DIODES

(75) Inventors: Gianluca Ragonesi, Fiumefreddo Di Sicilia (IT); Patrizia Milazzo, Sant'Agata Li Battiati (IT); Salvatore Musumeci, Fiumefreddo Di Sicilia (IT); Giuseppe Platania, Catania (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 1043 days.

(21) Appl. No.: 11/351,290

(22) Filed: Feb. 9, 2006

(65) Prior Publication Data

US 2006/0186827 A1 Aug. 24, 2006

(30) Foreign Application Priority Data

Feb. 11, 2005 (EP) ..... 05425065

(51) Int. Cl.
*H05B 37/02* (2006.01)

(52) U.S. Cl. ..... 315/209 R; 315/224; 315/225; 315/291

(58) Field of Classification Search ..... 315/209 R, 315/224, 241, 291, 307, 211, 214, 225, 245, 315/247, 308, 360, 362
See application file for complete search history.

(56) References Cited

U.S. PATENT DOCUMENTS

| | | | | |
|---|---|---|---|---|
| 6,057,651 | A * | 5/2000 | Usami | 315/291 |
| 6,690,146 | B2 * | 2/2004 | Burgyan et al. | 323/271 |
| 7,088,059 | B2 * | 8/2006 | McKinney et al. | 315/291 |
| 7,170,234 | B2 * | 1/2007 | Chikugawa et al. | 315/209 R |
| 2001/0043113 | A1 | 11/2001 | Hoshino et al. | 327/534 |
| 2002/0140380 | A1 | 10/2002 | Biebl | 315/291 |
| 2003/0117087 | A1 | 6/2003 | Barth et al. | 315/291 |

FOREIGN PATENT DOCUMENTS

| | | |
|---|---|---|
| DE | 101 31 845 A1 | 1/2003 |
| EP | 1 458 224 A2 | 9/2004 |

* cited by examiner

*Primary Examiner*—Douglas W Owens
*Assistant Examiner*—Jimmy T Vu
(74) *Attorney, Agent, or Firm*—Lisa K. Jorgenson; Robert Iannucci; Seed IP Law Group PLLC

(57) ABSTRACT

A device includes at least two circuit branches, each of said at least two circuit branches comprising at least one LED diode. The device comprises a supply circuit that provides an electric supply of said at least two circuit branches and includes a variable resistance. The device comprises a controller coupled to said at least two circuit branches and suitable for varying said resistance in reply to a variation of the current that flows in one of said at least two circuit branches to vary the electric supply of said at least two circuit branches.

23 Claims, 6 Drawing Sheets

SUPPLY DEVICE OF CIRCUIT BRANCHES WITH LED DIODES

BACKGROUND OF THE INVENTION

1. Field of the Invention

The present invention refers to a supply device of circuit branches with LED diodes.

2. Description of the Related Art

Liquid crystal displays are widely used in mobile telephones; said displays use a large number of LED diodes to permit the phenomenon of backlighting. The LED diodes are distributed in the displays uniformly and use the same bias current; to obtain this they are connected in series.

To feed serially connected chains of LED diodes that emit white light, devices suitable for increasing the supply voltage above the value of the supply voltage at their-input are employed.

The most adopted circuit solutions provide for the use of a boost converter which, supplying many branches connected in parallel and each one made up of a series of LED diodes, permit the setting of the current or the voltage on each one.

To regulate the current that passes through one or more branches of LED diodes there are two different modes: a current one and a voltage one.

In the first mode only the current of the main branch can be set. The output current is read and compared with a reference to generate a control in pulse width modulation (PWM) mode; the circuit branches that are not controlled directly can even have a current very different from that of the main branch.

The disadvantage lies in the parallel connection of the circuit branches. Even if the current that flows in the main branch with the highest number of diodes is controlled directly, the secondary circuit branches can have an additional voltage and a different current. Adding a series of resistances in the secondary branches the current set on the main branch can be reached seeing that the resistances compensate the voltage jump error between the main branch and the secondaries that is due to the connection in parallel. In any case even if the object is reached a consistent quantity of power dissipation (on the compensation resistances) causes the decrease in the efficiency of the control.

This disadvantage can be present not only when supplying the circuit branches with a different number of diodes, but also if the number of LED diodes is equal in all the branches. In fact the voltage jump between the LED diodes could be different even if the same current flows. As a consequence it is necessary to impose a different voltage jump for each branch, but this is not possible by connecting all the branches in parallel. Only by regulating the current that flows through the circuit branches with a maximum value of voltage jump and inserting variable resistances in the other circuit branches the parallel connection can be maintained.

The voltage mode provides for the setting of the output voltage for each circuit branch by means of a boost converter and a voltage divider. To control the current that flows through each circuit branch a resistance, connected in series to the LED diodes, is added to each circuit branch; said resistance enable the current required to be adjusted. Nevertheless the value of the current cannot be known in advance given that it depends on the voltage at the terminals of the circuit branches, on the number of LED diodes present in each branch and on the fall in voltage on each LED diode; the latter depends on the flow of current and on the process technology. Therefore the correct resistance value must be assessed in the different cases and must be set so as to compensate the variation of voltage due to the process technology.

BRIEF SUMMARY OF THE INVENTION

One embodiment of the present invention provides a supply device of circuit branches with LED diodes that overcomes the inconveniences of the known devices.

In one embodiment of the present invention, a supply device supplies at least two circuit branches, each of the at least two circuit branches comprising at least one LED diode. The device includes a supply circuit that provides the electric supply of the at least two circuit branches, the supply circuit comprising at least one variable resistance. The device also includes a controller coupled to the at least two circuit branches and suitable for varying the resistance in reply to a variation of the current that flows in one of the at least two circuit branches to change the electric supply of the at least two circuit branches.

Thanks to the present invention it is possible to produce a supply device of circuit branches with LED diodes that ensures the electric supply of each circuit branch preventing some circuit branch from turning off because of insufficient supply.

In a preferred embodiment said supply device guarantees the regulation of the current of each circuit branch.

BRIEF DESCRIPTION OF THE SEVERAL VIEWS OF THE DRAWINGS

The characteristics and advantages of the present invention will appear evident from the following detailed description of an embodiment thereof, illustrated as non-limiting example in the enclosed drawings, in which.

DETAILED DESCRIPTION OF THE INVENTION

Figure 1:
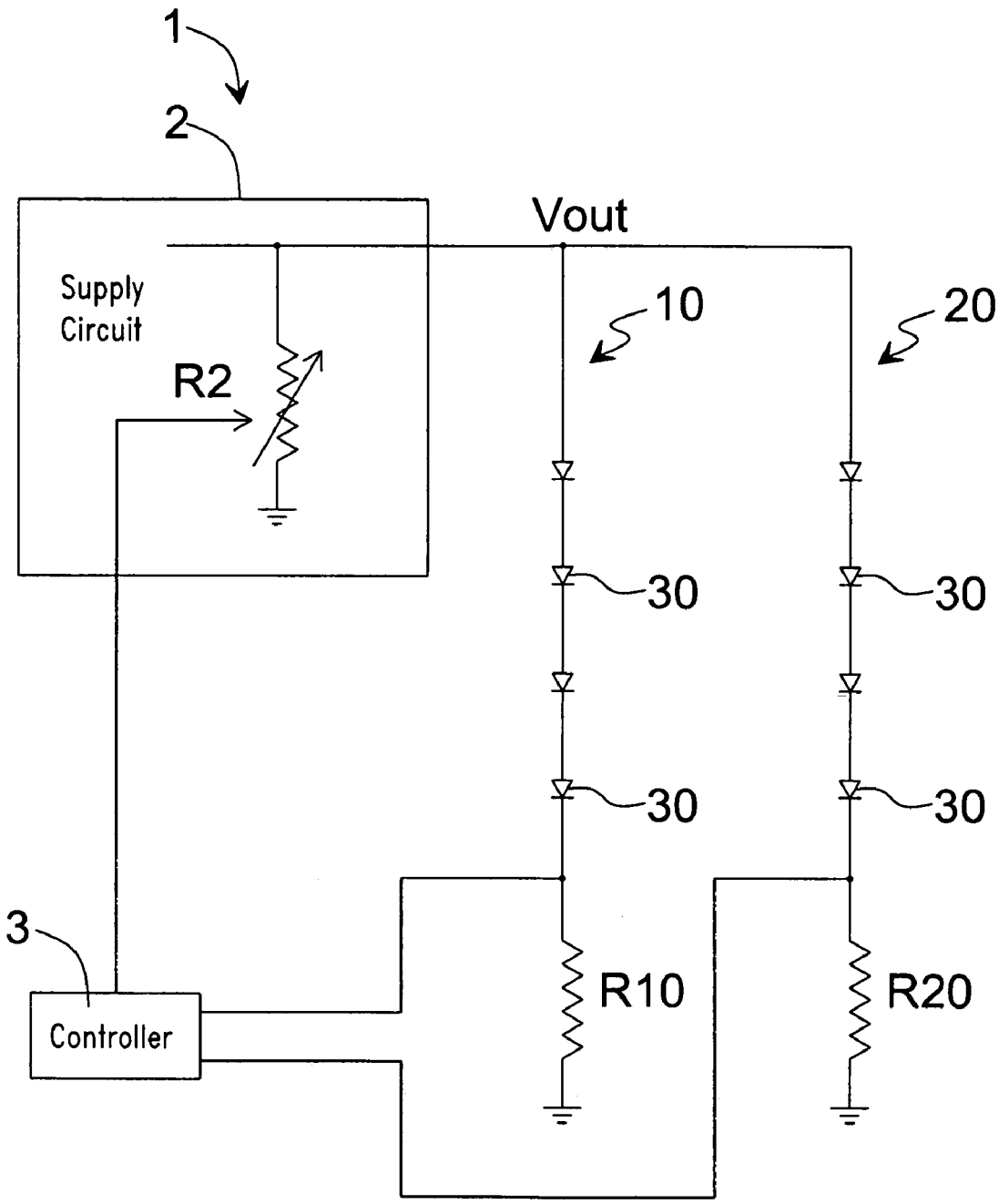
FIG. 1 is a circuit diagram of the supply device of circuit branches with LED diodes in accordance with one embodiment of the invention.

With reference to FIG. 1 a circuit diagram of a lighting circuit according to one embodiment of the present invention is shown. The lighting circuit includes a supply device 1 and at least two circuit branches 10, 20 with LED diodes that are powered by the supply device 1. Each of said at least two circuit branches 10, 20 comprises at least one LED diode 30; in particular in FIG. 1 each of the two circuit branches 10, 20 comprises four LED diodes 30. The device 1 comprises a supply circuit 2 suitable for supplying the electric supply of said at least two circuit branches 10, 20; said supply circuit 2 provides the supply voltage Vout of the circuit branches 10, 20. Said supply circuit 2 includes at least one resistance R2. Preferably said supply circuit 2 includes a resistive divider with a resistance R1 and the resistance R2 connected in series; the resistive divider is positioned in parallel to said at least two circuit branches 10, 20. The resistance R2 is a variable resistance and said supply device 1 comprises a control circuit 3 coupled to said at least two circuit branches 10, 20 and suitable for varying the resistance R2 in reply to a variation of the current of one of said at least two circuit branches 10, 20; in this manner the control circuit 3 changes the electric supply of said at least two circuit branches. The supply circuit 2 preferably comprises a boost converter (not visible in FIG. 1) and the voltage at the terminals of the said variable resistance R2 is used to vary the output voltage Vout to said boost converter.

Figure 2:
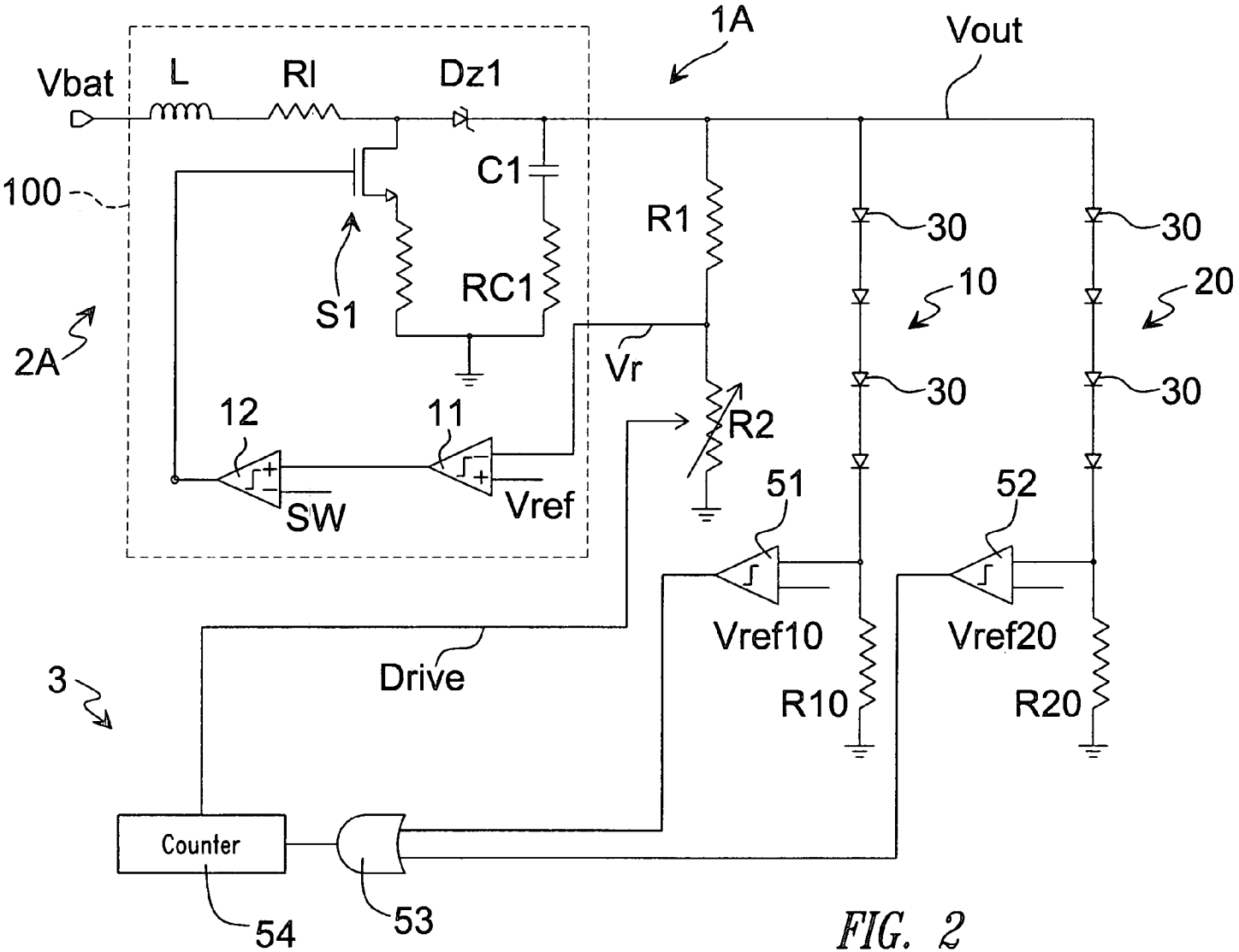
FIG. 2 is a circuit diagram of the supply device of circuit branches with LED diodes in accordance with a first embodiment of the invention.

FIG. 2 shows a supply device 1A of the at least two circuit branches 10, 20 with LED diodes in accordance with a first embodiment of the present invention. Each of the two circuit branches 10, 20 comprises at least one LED diode 30; in particular in FIG. 2 each of the two circuit branches 10, 20 comprises four LED diodes 30. The device comprises a supply circuit 2A suitable for providing the electric supply of said at least two circuit branches 10, 20. Said supply circuit 2A comprises, for example, a boost converter 100 of the traditional type; it comprises the series of an inductor L and a resistance RL connected between a voltage Vbat and a terminal of a switch S1, preferably made up of a MOS transistor. Said terminal of the switch S1 is connected to the anode of a Schottky diode Dz1 whose cathode is connected to a series of a capacitor C1 and a resistance Rc1 connected to ground and to the two circuit branches 10 and 20; the cathode of the diode Dz1 is also connected to the series of two resistances R1 and R2 connected to ground. The boost converter 100 comprises an operational error amplifier 11 having in input at the inverting terminal the voltage Vr at the terminals of the resistance R2 and at the non-inverting terminal the reference voltage Vref and a comparator 12 suitable for comparing the voltage in output from the error amplifier 11 with a sawtooth voltage SW; the output of the comparator 12 drives the switch S1.

The resistance R2 is a variable resistance and said supply device 1 comprises a control circuit 3A coupled to said at least two circuit branches 10, 20 and suitable for varying the resistance R2 in reply to a variation of the current of one of said at least two circuit branches 10, 20.

The two circuit branches comprise resistances R10 and R20 positioned between the final LED diode 30 and ground; said control circuit 3A is coupled at the terminals of said two resistances R10, R20.

The control circuit 3A includes a first comparator 51 and a second comparator 52 having the non-inverting terminals connected with a terminal of said resistances R10 and R20 while on the inverting terminal the reference voltages Vref10 and Vref20 are present. The signals in output from the two comparators are sent to an OR gate 53 and the signal in output from the OR gate is sent to a counter 54 which by means of a signal Drive drives the variable resistance R2. If the voltage at the terminals of the resistance R10 is lower than the voltage Vref10 or if the voltage at the terminals of the resistance R20 is lower than the voltage Vref20 the counter 54 will increase the value of the resistance R2 so that the current generator 100 sends a current with a higher value to the circuit branches 10 and 20. In this manner the ratio of division of the resistances R1 and R2 is not chosen in advance but is dynamically adjusted to obtain the correct supply voltage of the circuit branches 10 and 20. In fact, in this case account is taken of the process technology of the LEDs to reduce to a minimum the consumption of power, if a higher supply voltage than that required is regulated, or to prevent a circuit branch from being turned off because the supply voltage is not sufficient.

Figure 3:
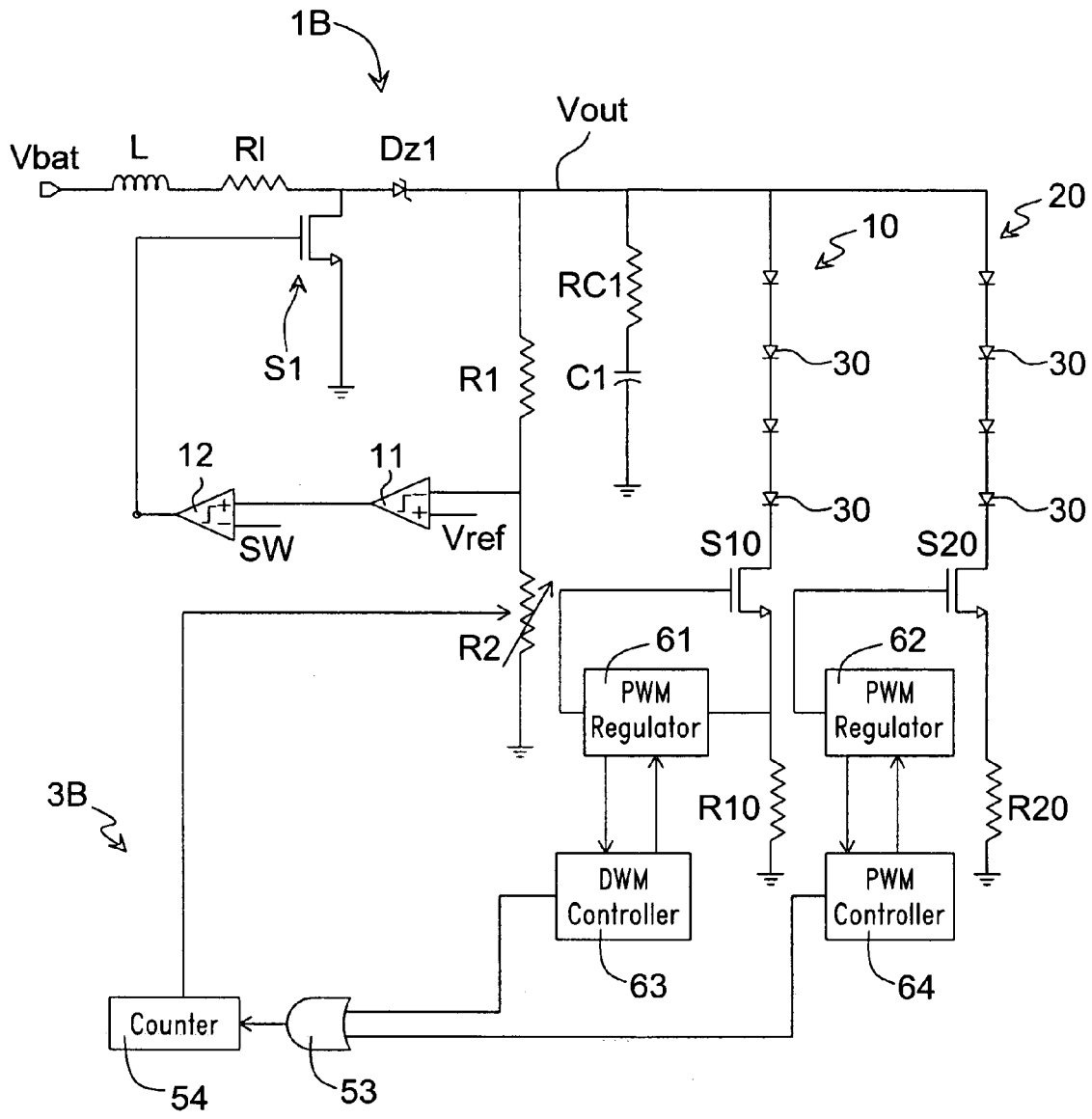
FIG. 3 is a circuit diagram of the supply device according to a second embodiment of the invention.

FIG. 3 shows a circuit diagram of a supply device 1B that supplies the circuit branches 10, 20 with LED diodes 30 in accordance with a second embodiment of the invention. The device 1B of FIG. 3 differs from the device of FIG. 2 in the different circuit typology of the control circuit 3B. The latter comprise switches S10 and S20, preferably transistors, positioned in the circuit branches 10 and 20 and connected between the final LED diode 30 of the series of four LED diodes 30 and the resistances R10 and R20. Each transistor S10, S20 is driven by a respective circuit block 61, 62 to obtain a pulse width modulation (PWM) regulation. The blocks 61 and 62 are capable of regulating the current that flows in the branches 10 and 20 with good precision. The blocks 61 and 62 regulate the duty-cycle D, that is they regulate the period of turn-on time Ton and the period of turn-off time Toff of the transistors S10 and S20 in a given period of time T; the duty-cycle D=(1−Toff)/Ton. In the starting conditions the resistance R2 is set at the lowest value; in this manner the value of the supply voltage Vout of the circuit branches 10 and 20 will also be at the lowest value. Each block 61, 62 will establish whether said voltage is sufficient for the supply of the respective circuit branch 10, 20. If the duty-cycle becomes unitary, that is the maximum period of turn-on time Ton is reached, the blocks 61, 62 will send signals to the other logic blocks 63 and 64. The latter will send said information to the counter device 54 that will increase the value of the resistance R2 to increase the value of the voltage Vout; the same blocks 63 and 64 will see to zeroing the duty-cycle relating to each switch S10, S11. More precisely, in the case of only two circuit branches 10 and 20, the signals in output from the logic blocks 63 and 64 are sent to a port OR 53 that sends its output signal to the counter device 54. Said procedure will be repeated until the value of the voltage Vout is such that it feeds all the circuit branches correctly, preventing them from turning off.

Figure 4:
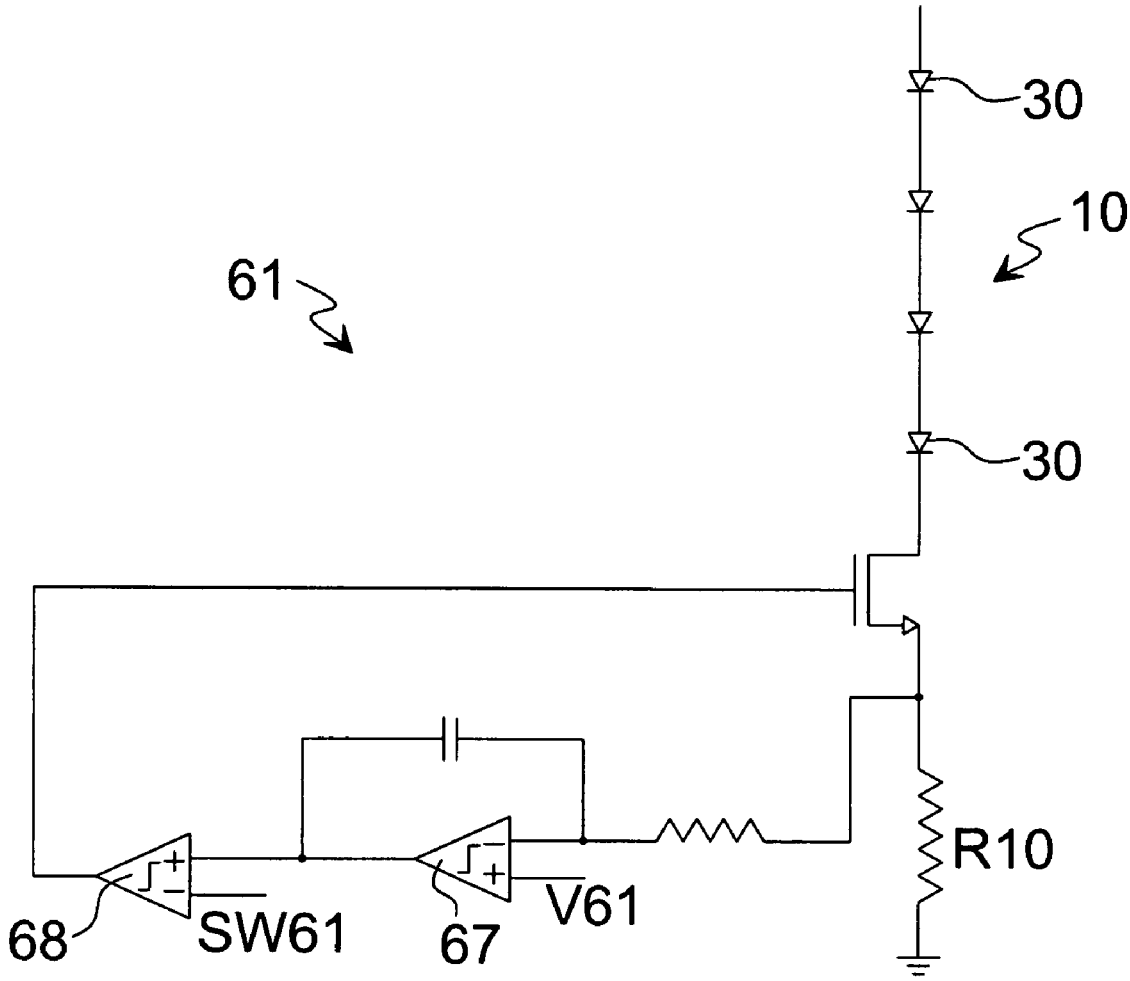
FIG. 4 shows more in detail a part of the circuit of FIG. 3.

The circuit block 61 is shown in more detail in FIG. 4. The circuit block 61 comprises an operational error amplifier 67 having the inverting terminal connected with the terminal that is not grounded of the resistance R10 and the non-inverting terminal connected to a reference voltage V61. The signal in output from the operational error amplifier is sent to the non-inverting terminal of a comparator 68 having the inverting terminal connected to a sawtooth voltage SW61. The output signal of said comparator 68 drives the switch S10. When the switch S10 is closed we obtain $$I10 = \frac{V\text{out} - 4V30}{R10 + Rs}$$

where V30 is the voltage at the terminals of each LED diode 30 and Rs is the resistance of the switch S10. The current is regulated at a value corrected by the feedback that forces the switch to turn on. In fact, with the sawtooth signal SW61, a pulsed signal with period T is generated and a pulse current I10 flows in the circuit branch 10. To regulate a correct average branch current Icorr it is necessary to impose V61=R10*Icorr so that the block 61 will regulate an average current Im=I10*D=Icorr.

Figure 5:
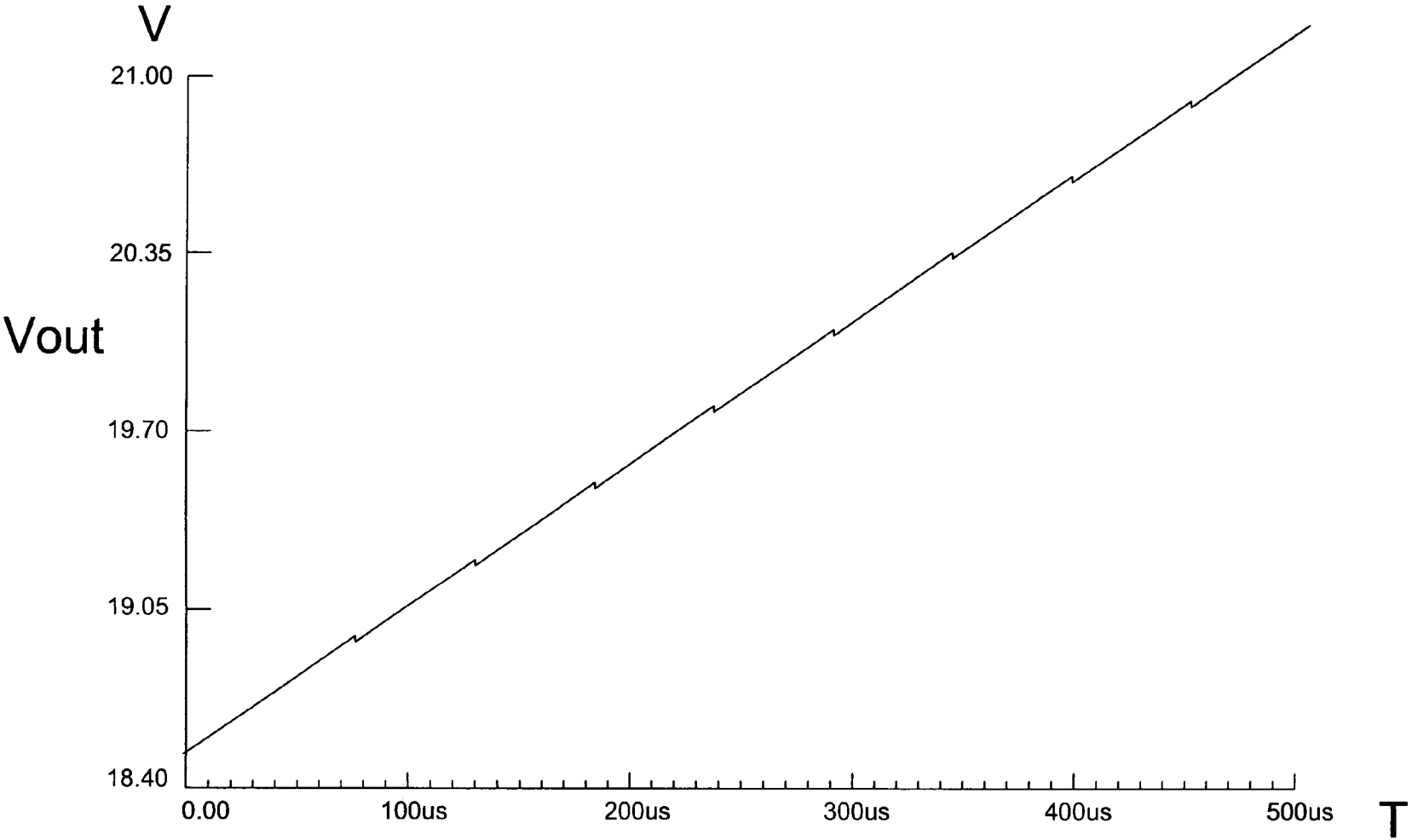
FIG. 5 shows the time diagram of the voltage Vout of the device of FIG. 3 in the initial period of supply time.
Figure 6:
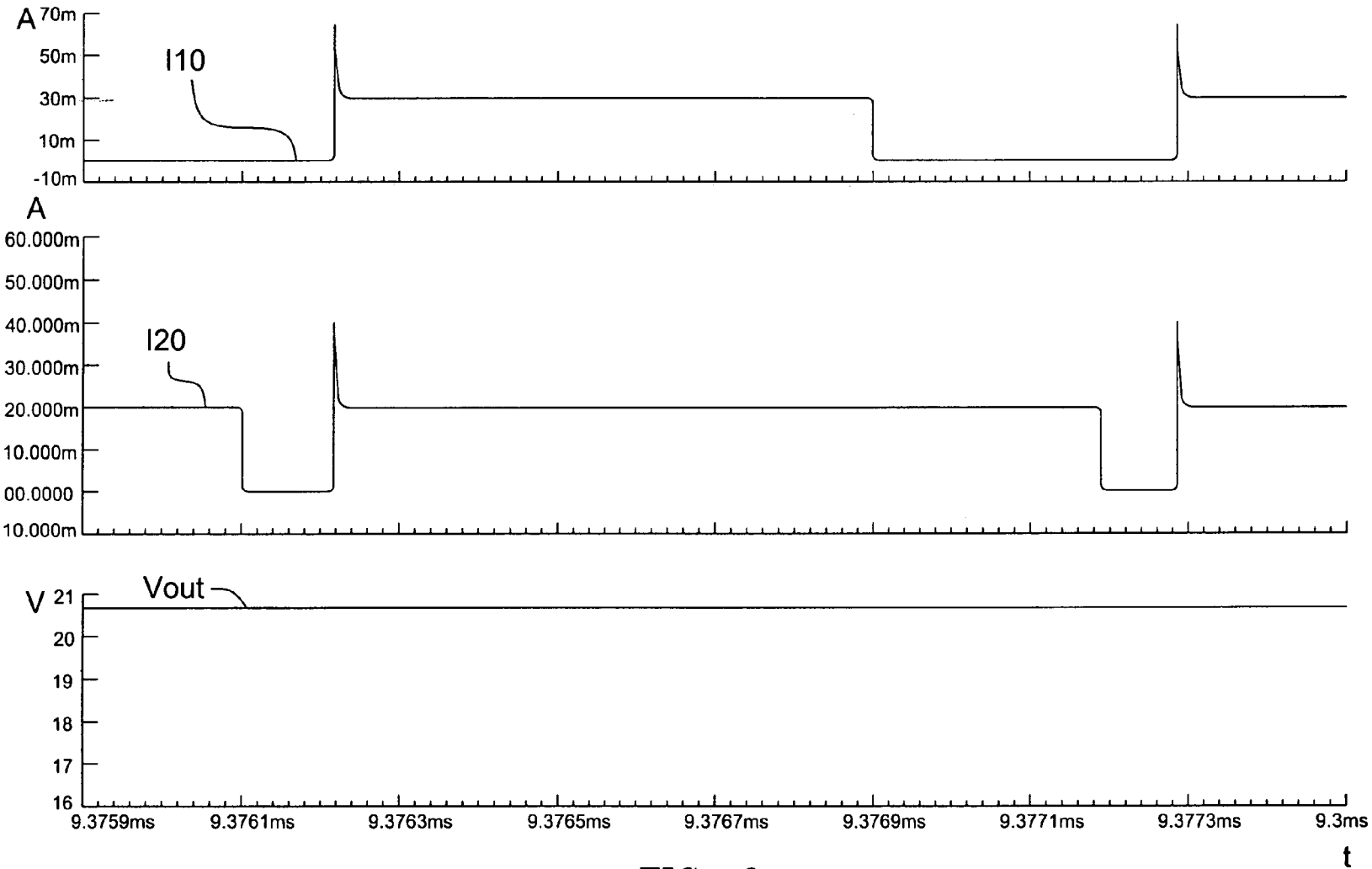
FIG. 6 shows time diagrams at the voltage and current regime in question in the device of FIG. 3.

FIG. 5 shows a time diagram of the course of the voltage Vout in the initial period of time, that is in initial transitory conditions, of the supplying of the circuit branches 10 and 20 for the device of FIG. 3. FIG. 6 shows the time courses of the currents I10, I20 and of the voltage Vout when the regime condition is reached again for the device of FIG. 3.

The supply device according to the invention is applicable to more than two circuit branches containing LED diodes and in which the same circuit branches can contain a different number of LED diodes.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A supply device for supplying at least two circuit branches, each of said at least two circuit branches including at least one LED diode, said device comprising:

means for providing an electric supply of said at least two circuit branches, said means comprising a variable resistance; and control means, coupled to said at least two circuit branches, for varying said resistance in reply to a variation of a current that flows in one of said at least two circuit branches to change the electric supply of said at least two circuit branches, wherein said means for providing the electric supply comprise a resistive divider positioned in parallel to said at least two circuit branches, said resistive divider comprising said variable resistance, said means for providing comprising a boost converter and a voltage at the terminals of said variable resistance being used to vary an output voltage to said boost converter.

2. The device according to claim 1 wherein said control means comprise detecting elements suitable for detecting current variations of each circuit branch of said at least two circuit branches.

3. A supply device for supplying at least two circuit branches, each of said at least two circuit branches including at least one LED diode, said device comprising:

means for providing an electric supply of said at least two circuit branches, said means comprising a variable resistance; and control means, coupled to said at least two circuit branches, for varying said resistance in reply to a variation of a current that flows in one of said at least two circuit branches to change the electric supply of said at least two circuit branches, wherein:

said control means comprise detecting elements suitable for detecting current variations of each circuit branch of said at least two circuit branches, said at least two circuit branches each comprise a resistance connected to ground, said detecting elements comprise comparators suitable for comparing respective voltages on said resistances of the circuit branches with respective reference voltages, and said control means are suitable for increasing a value of said variable resistance if at least one of the voltages detected on one of said resistances of the circuit branches is lower than the respective reference voltage.

4. A supply device for supplying at least two circuit branches, each of said at least two circuit branches including at least one LED diode, said device comprising:

means for providing an electric supply of said at least two circuit branches, said means comprising a variable resistance; and control means, coupled to said at least two circuit branches, for varying said resistance in reply to a variation of a current that flows in one of said at least two circuit branches to change the electric supply of said at least two circuit branches, wherein:

said control means comprise detecting elements suitable for detecting current variations of each circuit branch of said at least two circuit branches, said at least two circuit branches each comprise a resistance connected to ground and a switch, and said control means comprise further means suitable for regulating currents that flow in said at least two circuit branches by controlling duty-cycles of said switches.

5. The device according to claim 4, wherein said further means operate in pulse width modulation and comprise:

at least two operational error amplifiers, each one having an first input terminal connected to a respective one of the at least two circuit branches and a second input terminal connected to a further respective reference voltage; and at least two comparators each one suitable for comparing an output signal of a respective one of the operational error amplifiers with a sawtooth signal, said comparators providing output signals suitable for determining drive signals of said switches, respectively.

6. The device according to claim 4 wherein said detecting elements comprise logic means associated with said further control means, said logic means commanding an increase of a value of said variable resistance when said duty-cycle becomes unitary.

7. A supply device for supplying at least two circuit branches, each of said at least two circuit branches including at least one LED diode, said device comprising:

means for providing an electric supply of said at least two circuit branches, said means comprising a variable resistance; and control means, coupled to said at least two circuit branches, for varying said resistance in reply to a variation of a current that flows in one of said at least two circuit branches to change the electric supply of said at least two circuit branches, wherein said control means comprise detecting elements suitable for detecting current variations of each circuit branch of said at least two circuit branches, and said control means comprise a counter device suitable for changing a value of the variable resistance in reply to the variation of the current of the one of said at least two circuit branches.

8. The device according to claim 7, wherein said control means comprise at least one OR gate.

9. A lighting circuit, comprising:

a first circuit branch that includes a first LED diode;

a supply circuit that provides an electric supply to the first circuit branch, the supply circuit including a resistive divider with a variable resistance; and a control circuit having an input coupled to the first circuit branch and structured to vary the variable resistance based on a current in the first branch and vary the electric supply based on the varying of the variable resistance, wherein the supply circuit includes a boost converter that includes:

a switch coupled to the first circuit branch and having a control terminal; and an error amplifier having a first input coupled to the variable resistance, a second input coupled to a reference voltage, and an output coupled to the control terminal of the switch.

10. A lighting circuit, comprising:

a first circuit branch that includes a first LED diode;

a supply circuit that provides an electric supply to the first circuit branch, the supply circuit including a resistive divider with a variable resistance; and a control circuit having an input coupled to the first circuit branch and structured to vary the variable resistance based on a current in the first branch and vary the electric supply based on the varying of the variable resistance, wherein the first circuit branch includes a first resistor connected to the first LED diode at a first node, the lighting circuit further comprising a second circuit branch that includes a second LED diode and a second resistor connected to the second LED diode at a second node, wherein the control circuit includes:

a first comparator having a first input connected to the first node, a second input connected to a first reference voltage, and an output that provides a first comparison signal indicative of a comparison between a first voltage at the first node and a first reference voltage;

a second comparator having a first input connected to the second node, a second input connected to a second reference voltage, and an output that provides a second comparison signal indicative of a comparison between a second voltage at the second node and the second reference voltage; and a logic circuit coupled to the comparators and structured to change the variable resistance based on at least one of the comparison signals.

11. A lighting circuit, comprising:

a first circuit branch that includes a first LED diode;

a supply circuit that provides an electric supply to the first circuit branch, the supply circuit including a resistive divider with a variable resistance; and a control circuit having an input coupled to the first circuit branch and structured to vary the variable resistance based on a current in the first branch and vary the electric supply based on the varying of the variable resistance, wherein the first circuit branch includes a first resistor and a switch connected to the first LED diode, and the control circuit includes a regulator that regulates the current of the first circuit branch by controlling a duty-cycle of the switch.

12. The lighting circuit of claim 11, wherein the regulator includes:

an error amplifier having a first input terminal connected to the first circuit branch, a second input terminal connected to a reference voltage, and an output that provides an error amplifier signal; and a first comparator having a first input coupled to the output of the comparator, a second input coupled to a varying signal, and an output that provides a comparator signal based on a comparison of the error amplifier and varying signals, the output of the first comparator being coupled to a control terminal of the switch to control the duty-cycle of the switch.

13. The lighting circuit of claim 11 wherein the control circuit includes a logic circuit coupled to the regulator, the logic circuit being structured to cause an increase of the variable resistance when the duty-cycle becomes unitary.

14. A lighting circuit, comprising:

a first circuit branch that includes a first LED diode;

a supply circuit that provides an electric supply to the first circuit branch, the supply circuit including a resistive divider with a variable resistance; and a control circuit having an input coupled to the first circuit branch and structured to vary the variable resistance based on a current in the first branch and vary the electric supply based on the varying of the variable resistance, wherein the control circuit includes:

a first detector coupled to the first circuit branch and structured to detect a change in the current of the first circuit branch; and a counter coupled to the detector and structured to change the variable resistance in response to the change of the current of the first circuit branch.

15. The lighting circuit of claim 14, further comprising a second circuit branch that includes a second LED diode wherein the control circuit includes:

a second detector coupled to the second circuit branch and structured to detect a change in a current of the second circuit branch; and a logic gate having a first input coupled to the first detector, a second input coupled to the second detector, and an output coupled to the counter.

16. A lighting circuit, comprising:

a first circuit branch that includes a first LED diode;

a variable resistance;

a supply circuit that provides an electric supply to the first circuit branch, the supply circuit including a first error amplifier coupled to the variable resistances structured to change the electric supply provided to the first circuit branch in response to a change in the variable resistance; and a control circuit having an input coupled to the first circuit branch and structured to vary the variable resistance based on a current in the first branch, wherein the supply circuit includes a boost converter that includes a switch coupled to the first circuit branch and having a control terminal coupled to an output terminal of the first error amplifier.

17. The lighting circuit of claim 16 wherein the variable resistance is part of a resistive divider positioned in parallel to the first circuit branch.

18. A lighting circuit, comprising:

a first circuit branch that includes a first LED diode;

a variable resistance;

a supply circuit that provides an electric supply to the first circuit branch, the supply circuit including a first error amplifier coupled to the variable resistances structured to change the electric supply provided to the first circuit branch in response to a change in the variable resistance; and a control circuit having an input coupled to the first circuit branch and structured to vary the variable resistance based on a current in the first branch, wherein the first circuit branch includes a first resistor connected to the first LED diode at a first node, the lighting circuit further comprising a second circuit branch that includes a second LED diode and a second resistor connected to the second LED diode at a second node, wherein the control circuit includes:

a first comparator having a first input connected to the first node, a second input connected to a first reference voltage, and an output that provides a first comparison signal indicative of a comparison between a first voltage at the first node and a first reference voltage;

a second comparator having a first input connected to the second node, a second input connected to a second reference voltage, and an output that provides a second comparison signal indicative of a comparison between a second voltage at the second node and the second reference voltage; and a logic circuit coupled to the comparators and structured to change the variable resistance based on at least one of the comparison signals.

19. A lighting circuit, comprising:

a first circuit branch that includes a first LED diode;

a variable resistance;

a supply circuit that provides an electric supply to the first circuit branch, the supply circuit including a first error amplifier coupled to the variable resistances structured to change the electric supply provided to the first circuit branch in response to a change in the variable resistance; and a control circuit having an input coupled to the first circuit branch and structured to vary the variable resistance based on a current in the first branch, wherein the first circuit branch includes a first resistor and a switch connected to the first LED diode, and the control circuit includes a regulator that regulates the current of the first circuit branch by controlling a duty-cycle of the switch.

20. The lighting circuit of claim 19, wherein the regulator includes:

a second error amplifier having a first input terminal connected to the first circuit branch, a second input terminal connected to a reference voltage, and an output that provides an error amplifier signal; and a first comparator having a first input coupled to the output of the comparator, a second input coupled to a varying signal, and an output that provides a comparator signal based on a comparison of the error amplifier and varying signals, the output of the first comparator being coupled to a control terminal of the switch to control the duty-cycle of the switch.

21. The lighting circuit of claim 19 wherein the control circuit includes a logic circuit coupled to the regulator, the logic circuit being structured to cause an increase of the variable resistance when the duty-cycle becomes unitary.

22. A lighting circuit, comprising:

a first circuit branch that includes a first LED diode;

a variable resistance;

a supply circuit that provides an electric supply to the first circuit branch, the supply circuit including a first error amplifier coupled to the variable resistances structured to change the electric supply provided to the first circuit branch in response to a change in the variable resistance; and a control circuit having an input coupled to the first circuit branch and structured to vary the variable resistance based on a current in the first branch wherein the control circuit includes:

a first detector coupled to the first circuit branch and structured to detect a change in the current of the first circuit branch; and a counter coupled to the detector and structured to change the variable resistance in response to the change of the current of the first circuit branch.

23. The lighting circuit of claim 22, further comprising a second circuit branch that includes a second LED diode wherein the control circuit includes:

a second detector coupled to the second circuit branch and structured to detect a change in a current of the second circuit branch; and a logic gate having a first input coupled to the first detector, a second input coupled to the second detector, and an output coupled to the counter.

* * * * *